US006363845B1

(12) United States Patent
Honda

(10) Patent No.: US 6,363,845 B1
(45) Date of Patent: Apr. 2, 2002

(54) METHOD OF TRANSFERRING A SHEET THROUGH A WORKING APPARATUS

(75) Inventor: Noriyuki Honda, Aichi (JP)

(73) Assignee: Meinan Machinery Works, Inc., Aichi (JP)

( * ) Notice: Subject to any disclaimer, the term of this patent is extended or adjusted under 35 U.S.C. 154(b) by 0 days.

(21) Appl. No.: 09/498,953

(22) Filed: Feb. 4, 2000

(30) Foreign Application Priority Data

Feb. 9, 1999 (JP) ..... 11-070698

(51) Int. Cl.[7] ..... B30B 15/34; B30B 15/30; B30B 15/32

(52) U.S. Cl. ..... 100/38; 100/215; 100/218; 100/92; 100/71

(58) Field of Search ..... 100/38, 215, 218, 100/71, 74, 92, 302; 271/182, 184; 144/348, 352, 359, 364; 414/222.04, 757, 777, 794.7, 794.8

(56) References Cited

U.S. PATENT DOCUMENTS 3,909,343 A * 9/1975 Posselt ..... 100/215
4,253,891 A * 3/1981 Posselt ..... 100/215
4,967,899 A * 11/1990 Newsome ..... 198/415
5,562,281 A * 10/1996 Honda et al. ..... 414/794.7
5,662,760 A * 9/1997 Tsuda ..... 100/38
6,007,659 A * 12/1999 Hasegawa ..... 144/348

* cited by examiner

*Primary Examiner*—Peter Vo
*Assistant Examiner*—Louis K. Huynh
(74) *Attorney, Agent, or Firm*—Morgan & Finnegan, LLP

(57) ABSTRACT

According to a method of transferring a sheet through a working apparatus, a first sheet is moved by feed rolls partially into a working area of the working apparatus, which is followed by moving a second sheet by the same feed rolls to allow the leading end of the second sheet to be brought into abutment with the trailing end of its preceding first sheet and then to push the first sheet to a predetermined position within the working area. After the first sheet is thus placed and the second sheet is moved back out of the working area, the apparatus is operated to work the first sheet, for example, by pressing. The second sheet is moved forward into abutment with the trailing end of the worked first sheet and moved further while pushing the first sheet toward delivery rolls of the apparatus, which then removes the first sheet out of the working area of the apparatus. Such steps of operation is repeated to transfer a series of sheets successively through the working apparatus.

8 Claims, 7 Drawing Sheets

METHOD OF TRANSFERRING A SHEET THROUGH A WORKING APPARATUS

FIELD OF THE INVENTION

The present invention relates to a method of conveying or transferring a sheet material through a working apparatus. More specifically, the invention relates to a method of transferring a sheet of wood veneer through a hot press type drying apparatus.

BACKGROUND OF THE INVENTION

There has been known a veneer dryer having a pair of hot plates which are disposed one above the other for drying a sheet of wood veneer by hot pressing the sheet therebetween. In such dryer, a green or undried veneer sheet is moved from one end of the dryer to a predetermined position within the dryer, where the veneer sheet is hot pressed for a predetermined length of time for drying to a desired extent. After the drying has been completed, the dried veneer sheet is moved out of the apparatus through the opposite end thereof.

For better understanding of underlying problems and objects of the invention, reference will be made to FIGS. 24 to 27 which show a typical hot press type veneer dryer. It is to be understood that in describing the drawings only those portions of the construction of the dryer has been shown which enable those skilled in the art to readily understand the underlying principle and concept of the present invention.

Referring to FIG. 24 which is a schematic side view of the hot plate dryer and FIG. 25 which is a fragmentary plan view as seen from dash-and-dot line A—A in arrow direction, a pair of hot plates 101, 103 are disposed one above the other, of which the lower plate 101 is stationary while the upper plate 103 is movable toward and away from the stationary lower plate 101, as indicated by arrow. Seen in the direction in which veneer sheets are transferred through the dryer, or from right to left as viewed in the drawings, the hot plates 101, 103 have a longitudinal dimension L1, respectively, corresponding to the maximum working length of the dryer, while each veneer sheet 115 to be worked by the dryer has a longitudinal dimension L2 as measured in the same direction, and this L2 is smaller than L1, as best seen FIG. 26.

Adjacent to the upstream end, or right hand side as seen in FIG. 24, of the hot plates 101, 103 is located a plurality of feed rolls 105 mounted on a common drive shaft and rotating constantly in the arrow direction for moving a veneer sheet 115 into the dryer. On the opposite downstream end of the apparatus is provided a plurality of pairs of delivery rolls 107 mounted on drive shafts, respectively, of which the lower rolls are constantly rotatable in the arrow direction, while the upper idle rolls 107 are spaced apart from their corresponding lower rolls at an appropriate distance for holding therebetween and conveying a dried veneer sheet out of the dryer.

As shown in FIG. 25, a veneer sheet loading device is provided on lateral side of the dryer adjacent to the feed rolls 105, which includes an arm 113 reciprocally swingable about a pivot 111 and having at one end thereof a pusher 109. The arm 113 is normally located in its inoperative position as indicated by solid line and swingable by means of any suitable actuator such as pneumatic or hydraulic cylinder to its operative positions 109*a* and 109*b* indicated by phantom lines, respectively. Though not shown in FIG. 25, a similar device including an arm 113 and its related parts is located on the opposite side of the dryer in a symmetrical relation with respect to longitudinal center line (not shown) of the dryer. These two loading devices on opposite sides of the apparatus are operable in a synchronous manner for placing an undried veneer sheet to a predetermined position within the apparatus and also moving a dried veneer sheet partially out of the apparatus, as will be explained below.

In operation, a sheet of green veneer 115 is conveyed by the feed rolls 105 toward the dryer and inserted between the hot plates 101, 103. Movement of the veneer sheet 115 is stopped when the trailing end of the sheet 115 has just moved past the feed rolls 105 as shown in FIGS. 24, 25 and, therefore, conveying action of the rolls 105 is imparted to the veneer sheet 115 no more. As shown in FIGS. 24, 25, the veneer sheet 105 is partially inserted between the hot plates 101, 103 with part of its trailing end portion lying outside the hot plates 101, 103. Subsequently, the loading devices are actuated simultaneously to swing the arms 113 inward, or counter clockwise direction as seen in FIG. 25 for the arm 113 illustrated in FIG. 25 and opposite direction for the similar arm 113 (not shown) located on the opposite side of the dryer. By so doing, the pushers 109 are swung into contact with the trailing end of the veneer sheet 105, then moving the sheet along the upper surface of the stationary hot plate 101. The arms 113 are turned until the pushers 109 reach position 109*a,* where the veneer sheet 115 lies well within the working area or the longitudinal extension of the hot plates 101, 103 as shown in FIG. 26. After the veneer sheet 115 is thus positioned in place between the hot plates 101, 103, the arms 113 are swung back to their original position shown in FIG. 25, and the upper hot plate 103 is lowered as indicated by arrow in FIG. 26 to press and heat the veneer sheet for a predetermined length of time for drying.

After drying of the veneer sheet 115 has been completed, the upper hot plate 103 is elevated as shown in FIG. 27 and the arms 113 are swung again then to position 19*b* to move the dried veneer sheet 115 from the position of FIG. 26 to a position shown in FIG. 27 where the leading end of the sheet 115 can be caught and held by the delivery rolls 107. Thus, the dried veneer sheet 155 is conveyed by the delivery rolls 107 out of the dryer to any subsequent working station (not shown).

As understood by those skilled in the art, the presence of the sheet loading equipment inevitably complicates the veneer dryer and hence increases its manufacturing cost. Furthermore, addition of such devices require troublesome maintenance and therefore additional cost.

SUMMARY OF THE INVENTION

Accordingly, an object of the invention is to provide a method of transferring a sheet such as wood veneer sheet through a working apparatus which dispenses with the above-described veneer sheet loading equipment or similar devices.

According to the invention, a working apparatus in which a method of the invention is performed has a working area with a dimension L1 as measured along the direction in which the sheet is transferred, while a sheet to be transferred through the working apparatus has a dimension L2, as measured along the same direction, which is smaller than the dimension L1. The working apparatus includes feed means in the form of rotatable rolls disposed adjacent to one end of the working area and capable of moving the sheet partially or incompletely into the working area with part of the trailing end portion of the sheet lying outside the working area and delivery means such as rotatable rolls disposed adjacent to the opposite end of the working area of the working apparatus for removing the sheet therefrom.

In such working apparatus, a first sheet is moved by the feed means partially into the working area. Then, a second sheet is moved by the feed means into abutment of the leading end thereof with the trailing end of its preceding first sheet and moved further thereby to cause the second sheet to push its preceding first sheet to a predetermined position within the working area. When this position has been reached by the first sheet, the feed means is stopped and then reversed to move back the second sheet out of the working area. After the first sheet has been thus positioned in place within the working area of the apparatus and the succeeding sheet has been moved clear of the working area, the apparatus is operated to work the first sheet, for example, by pressing. The feed means is activated again to move the second sheet into abutment with the trailing end of its preceding worked first sheet and moved further while allowing the second sheet to push the first sheet toward the delivery means. The second sheet is moved to a position to which the first sheet was previously moved by the feed means, while the first sheet is removed by the delivery means out of the working area of the apparatus. Such steps of operation is repeated to transfer a series of sheets successively through the working apparatus. Since a sheet fed into the working apparatus incompletely can be moved by another sheet that follows to a predetermined position within the working area, loading equipment as described above with reference to prior art apparatus may be dispensed with.

According an embodiment of the invention, the step of reversing the feed means to move back the second sheet out of the working area may be omitted. For example, after a first sheet has been moved partially into the working area, it may be worked as it is with part of its trailing end portion lying outside the working area if such working is acceptable. The worked sheet can be removed by moving a second sheet by the feed means into abutment of the leading end thereof with the trailing end of its preceding worked first sheet and further to a position to which the first sheet was previously moved by the feed means, while causing the second sheet to push the first sheet toward the delivery means.

In still another embodiment, a first sheet fed incompletely into the working area is moved by being pushed by a second sheet to a predetermined position within the working area of the apparatus. Then, working by the apparatus may be done for the entire of said first sheet and part of the leading end portion of the second sheet which then lies within the working area. By so doing, the step of reversing the feed means may be omitted. The second sheet is moved by the feed means to a position to which the first sheet was previously moved by the feed means, so that the first sheet is pushed to move toward the delivery means, which then removes the sheet from the working apparatus.

Additionally, the working apparatus may include aligning means in the form a stop member disposed between one end of the working area and the feed means and extending perpendicularly to the extension L1 of the working area of the apparatus for aligning or orienting each sheet straight with respect to the direction in which the sheet is moved by the feed means. In such a case, method of the invention further comprises a step of aligning each sheet by the aligning means before it is moved by the feed means into the working area.

BRIEF DESCRIPTION OF THE DRAWINGS

The features and advantages of the present invention will become apparent to those skilled in the art from the following description of embodiments according to the invention, which description is made with reference to the accompanying drawings, wherein.

DETAILED DESCRIPTION OF PREFERRED EMBODIMENTS

Figure 1:
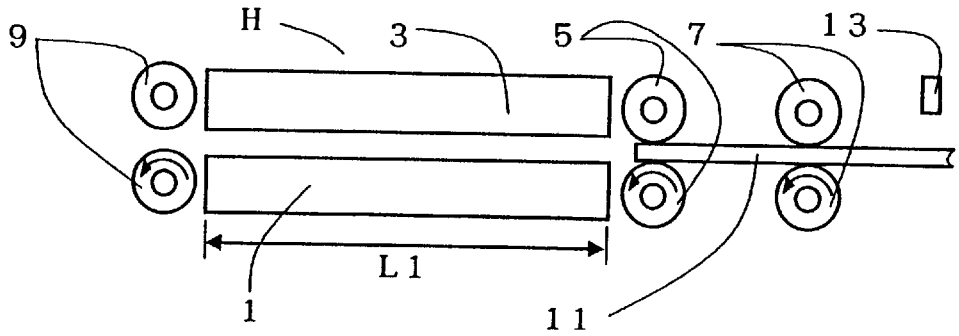
FIGS. 1 to 12 are schematic illustrative side views of a hot press type veneer drying apparatus, showing steps of operation of the apparatus in a preferred embodiment of method of transferring sheets successively through the apparatus according to the present invention.

Referring to FIG. 1, a hot press type veneer dryer H is shown which includes a pair of hot plates 1, 3 disposed one above the other and each having a longitudinal dimension L1 as measured in the direction in which a veneer sheet 11 is moved through the dryer as will be described later. The lower hot plate 1 is stationary while the upper plate 2 is movable toward and away from the stationary hot plate 1 thereby to form a daylight or a space between the plates 1, 3 into which a green or undried veneer sheet 11 may be inserted and hot pressed for drying. Each of the veneer sheets 11 has a longitudinal dimension L2 as measured in the same direction and that this dimension L2 is smaller than L1, as most clearly seen in FIG. 6.

Adjacent to the upstream end, or right hand side as seen in FIG. 1, of the dryer H is located a plurality of feed rolls including two groups 5, 7 of such rolls. Each group of feed rolls 5, 7 includes a pair of roll assemblies disposed one above the other and each assembly comprising a common shaft extending perpendicularly to the longitudinal extension L1 of the hot plates 1, 3 and a plurality of rolls mounted on the shaft at a spaced intervals in the same manner as in the case of feed rolls 105 shown in FIG. 25 and described with reference to a conventional veneer sheet transferring method. In each pair of roll assemblies, the lower feed rolls 5, 7 are rotatable at the same speed in forward and reverse directions as indicated by arrows, for example, in FIGS. 1 and 6 to move a veneer sheet 11 toward and away the space between the hot plates 1, 3. The upper feed rolls 5, 7 are idle and spaced apart from their driven counterparts so that the veneer sheet 11 may be held therebetween and moved in either direction depending on the direction in which the lower roll 5, 7 are then driven to rotate.

Adjacent to the opposite downstream end of the dryer H is provided a pair of delivery roll assemblies disposed one above the other, each assembly comprising a common shaft extending parallel to the shaft of the feed rolls 5, 7 and a plurality of delivery rolls 9 mounted on the shaft at a spaced intervals in the same manner as in the case of feed rolls 5, 7. In each pair of delivery roll assemblies, the lower delivery rolls 9 are positively driven to rotate in the arrow direction at a peripheral speed which is the same as or slightly higher than that of the driven feed rolls 5, 7 when they are rotating in forward direction. The upper delivery rolls 9 are idle and spaced apart from their driven counterparts so that the veneer sheet 11 may be caught and held therebetween and moved leftward as seen in FIG. 1.

Figure 5:
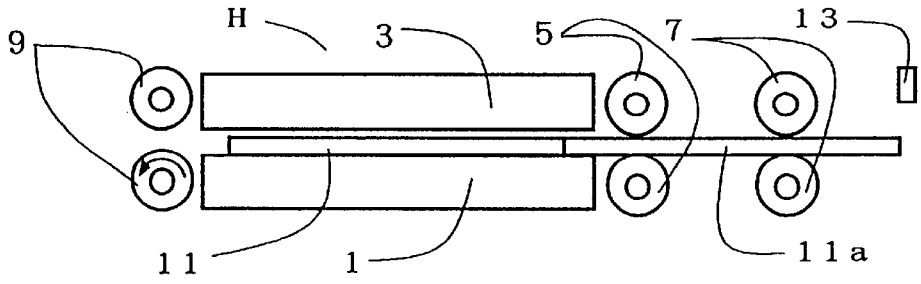

The veneer dryer H further includes an optical switch 13 of diffuse reflection type which is located and operable as a sensor so as to detect the trailing end of a veneer sheet 11*a* that follows its preceding veneer sheet 11 as shown in FIG. 5 and as will be described in detail in later part hereof. The sensor 13 is adapted to generate a signal to a control (not shown) which in turn controls the operation of the lower driven feed rolls 5, 7 in response to such signal from the sensor 13.

The follow will describe the manner of operation of the above-described hot press type veneer dryer H. As will be readily understood by those skilled in the art from the following description, each veneer sheet should be transferred through the dryer in such a position that its general fiber orientation is directed along the path in which the veneer sheet is moved for the sake of stability in transferring operation. Additionally, veneer sheet should be thick enough, for example 3 mm or more, to resist abutting shock as will be described in detail later, although the invention does not limit the sheet thickness to the above exemplified dimension. It is also noted that, for the sake of illustration in the drawings for better understanding of the invention, veneer sheet thickness is shown much larger than actual.

Figure 2:
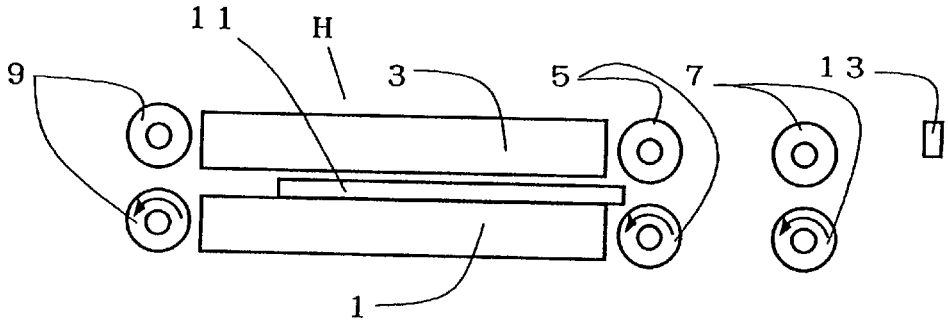

Firstly, reference will be made to FIGS. 1 to 12 which show the preferred embodiment of the present invention. Referring to FIG. 1 showing an initial state of the dryer H which is about to receive a first green veneer sheet 11, the upper hot plate 3 is placed in its elevated position to form a space with the stationary lower plate 1 for receiving therein veneer sheet 11 and the lower feed rolls 5, 7 are being rotated in forward direction as indicated by arrows. Thus, the first veneer sheet 11 inserted between the top and bottom feed rolls 5, 7 is fed toward the space between the hot plates 1, 3. After the trailing end of the veneer sheet 11 has cleared or moved past the feed rolls 5 which are located adjacent to the hot plates 1, 3, the sheet is stopped at a position between the hot plates 1, 3, as shown in FIG. 2, where part of the trailing end portion of the sheet 11 lies outside the working area or longitudinal extension L1 of the hot plates 1, 3. It is to be noted that the position reached by each veneer sheet in FIG. 2 is not necessarily constant, but variable depending on various factors such as surface condition of veneer sheet, the speed at which the feed rolls 5, 7 are driven to rotate, etc.

Figure 3:
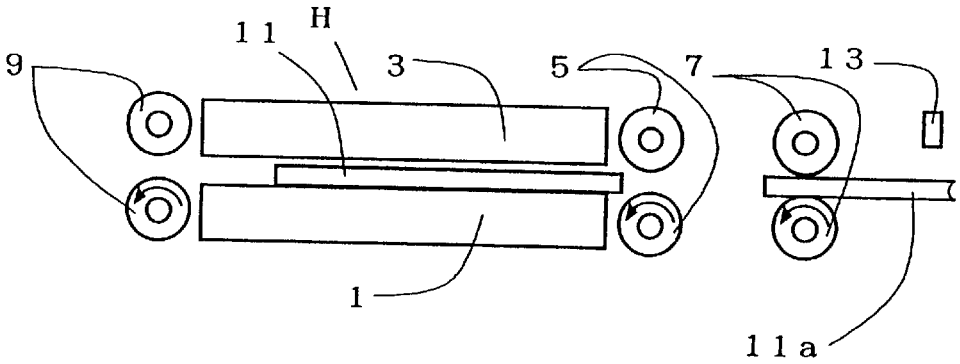
Figure 4:
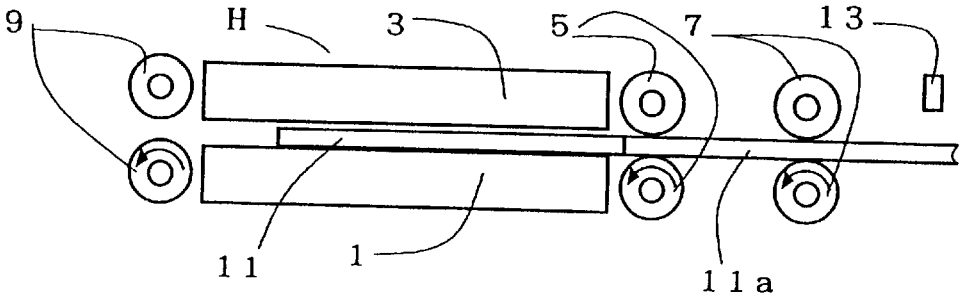
Figure 6:
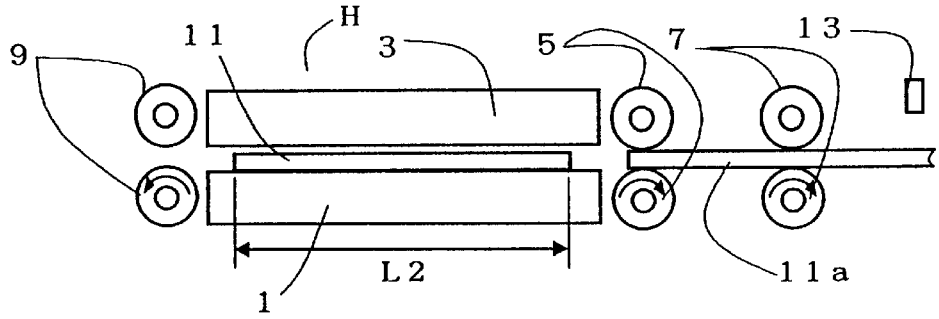

Then, a succeeding veneer sheet 11*a* is fed by the rolls 5, 7, moving forward into abutment with the trailing end of its preceding veneer sheet 11 as shown in FIGS. 3 and 4, whereupon the veneer sheet 11 is pushed forward by the succeeding veneer sheet 11*a*. Forward rotation of the feed rolls 5, 7 is continued with the abutment relation between the leading end of the veneer sheet 11*a* and the trailing end of its preceding veneer sheet 11 being maintained, until a position shown in FIG. 5 is reached, where the veneer sheet 11 is located entirely within the working area or the longitudinal extension L1 of the hot plates 1, 3. This position may be determined by the sensor 13 then detecting the passage of the trailing end of the veneer sheet 11*a* and simultaneously generating a detection signal to the control, which in turn causes the lower feed rolls 5, 7 to stop their rotation in response to such signal from the sensor 13. Then, the control causes the feed rolls 5, 7 to rotate in reverse direction only for a short period of time, for example one second, to move the succeeding veneer sheet 11*a* back to a position as shown in FIG. 6.

Figure 7:
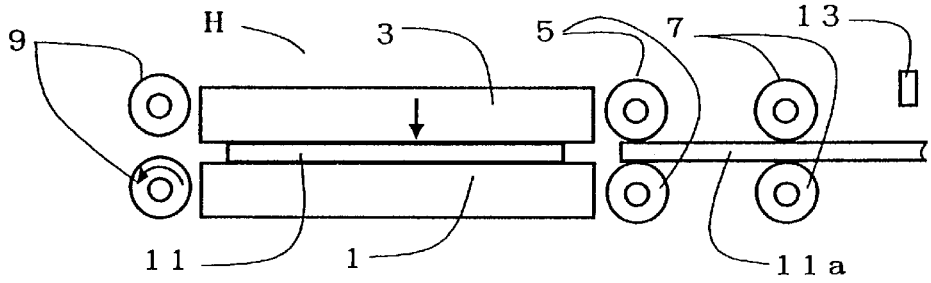
Figure 8:
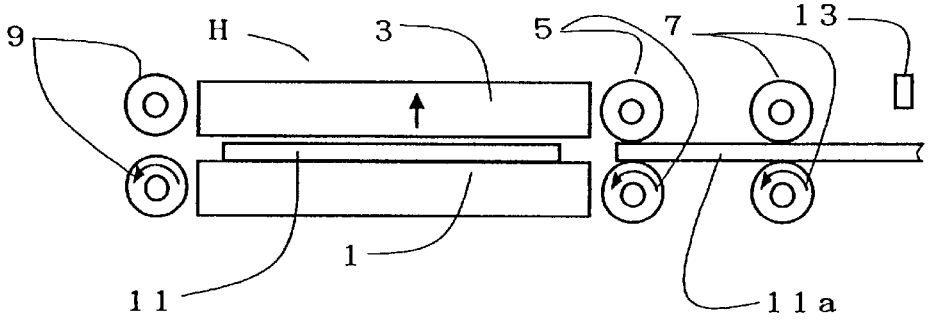
Figure 9:
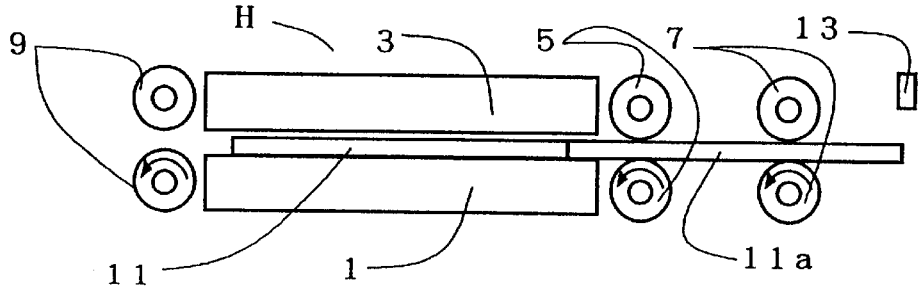
Figure 10:
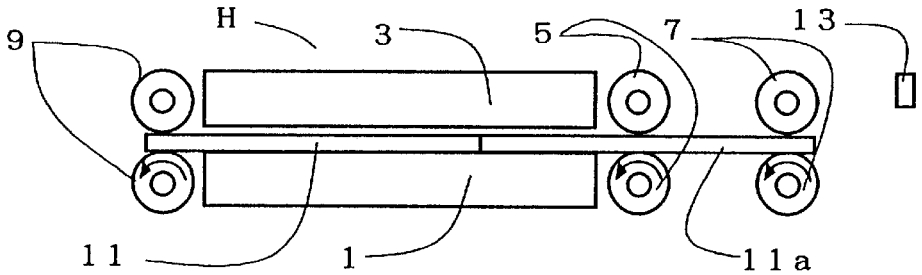

Subsequently, the control is operated to generate a signal to move the upper hot plate 3 to its operative position to hot press the veneer sheet 11 by the upper and lower hot plates 1, 3, as shown in FIG. 7. This hot pressing is continued for a predetermined length of time for the desired drying effect of veneer sheet 11. After an elapse of this time, the hot plate 3 is elevated to its original position as shown in FIG. 8 and the lower feed rolls 5, 7 are driven to rotate in forward direction to move the veneer sheet 11*a* into abutment with the trailing end of its preceding sheet 11 in the dryer H as shown in FIG. 9 and then pushes the veneer sheet 11 forward as shown in FIG. 10. When the leading end of the veneer sheet 11 has reached the delivery rolls 9 as shown in FIG. 10, the sheet 11 is moved forward then by the delivery rolls 9.

Figure 11:
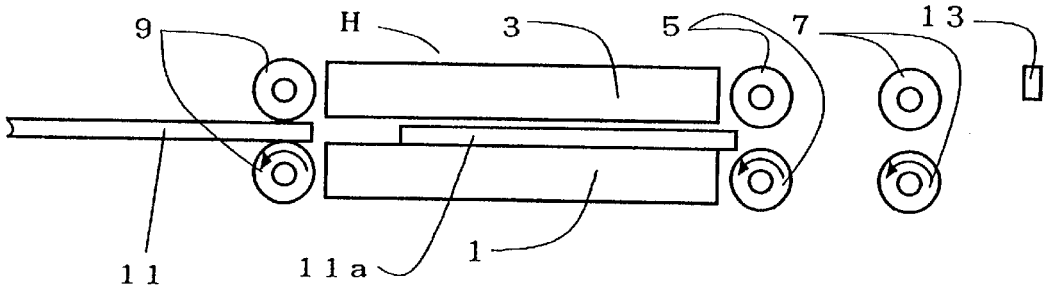
Figure 12:
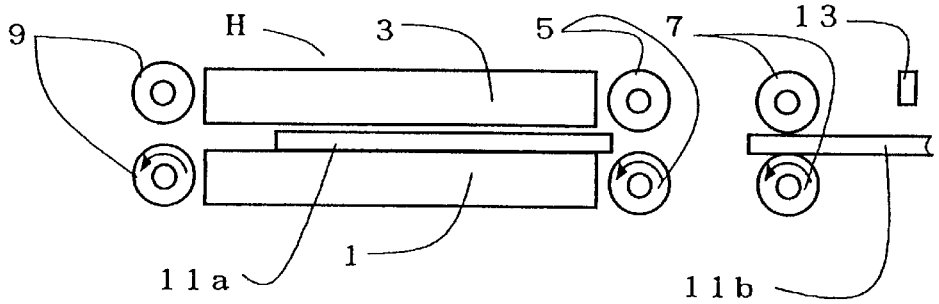

Thus, the dried veneer sheet 11 can be removed completely out of the dryer H and may be transferred further to any subsequent working station (not shown). Movement of the succeeding veneer sheet 11*b* is stopped after its trailing end has moved past of the feed rolls 5 adjacent to the hot plates 1, 3, as shown in FIG. 11. Then, a further veneer sheet 11*b* is conveyed by the feed rolls 5, 7 as shown in FIG. 12, and steps of operation which have been described with reference to FIGS. 4 to 11 are repeated to work veneer sheets successively.

Figure 25:
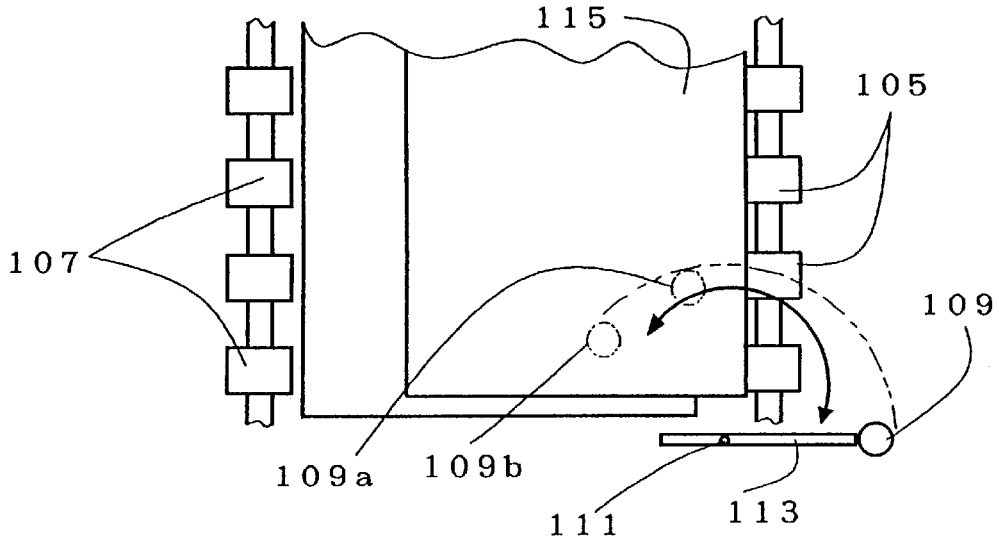
FIG.25 PRIOR ART
Figure 26:
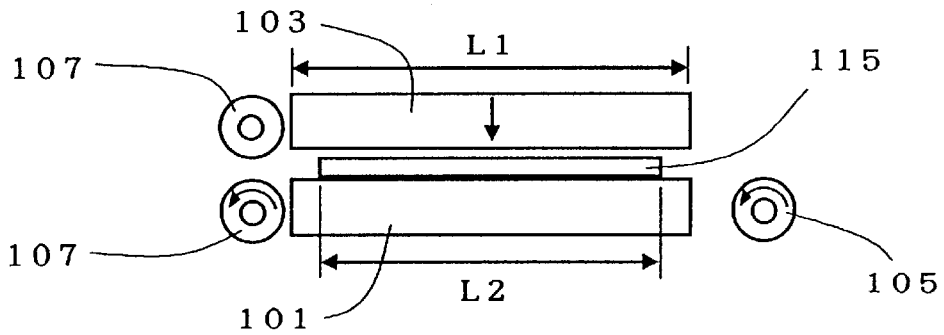
FIG.26 PRIOR ART
Figure 27:
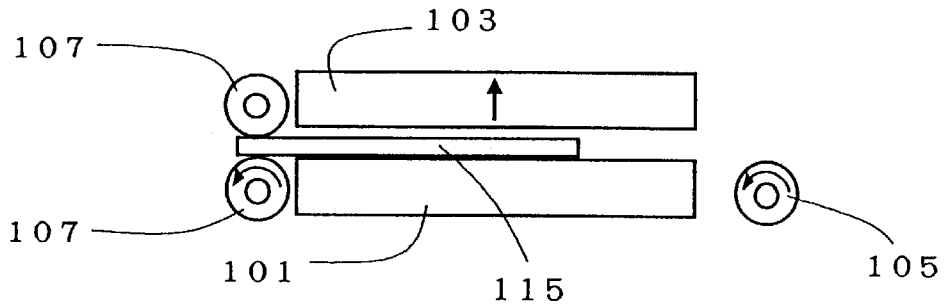
FIG.27 PRIOR ART

The sheet transferring method according to the present invention can thus dispense with equipment for loading a sheet to a predetermined position within a working apparatus, such as the one which has been described with reference to FIG. 25. Furthermore, the method of the invention accomplishes transferring successive sheets through the working apparatus by merely controllably operating the feed rolls. These features of the invention can simplify the working apparatus and hence reduce the apparatus cost and facilitates maintenance procedure.

It is noted that the method according to the present invention is not necessarily limited to the above-described embodiment, but it can be practiced in other manners as exemplified in the following.

In the preferred embodiment illustrated in FIGS. 1 to 12, after the veneer sheet 11 being pushed by its succeeding sheet 11*a* has reached position within the dryer H as shown in FIG. 5, the feed rolls 5, 7 are stopped and then reversed to cause the succeeding veneer sheet 11*a* to move back to the position shown in FIG. 6, so that veneer sheets are pressed successively one entire sheet after another as shown in FIG. 7. However, the method of the invention may dispense with the step of reversing the feed rolls 5, 7.

Figure 13:
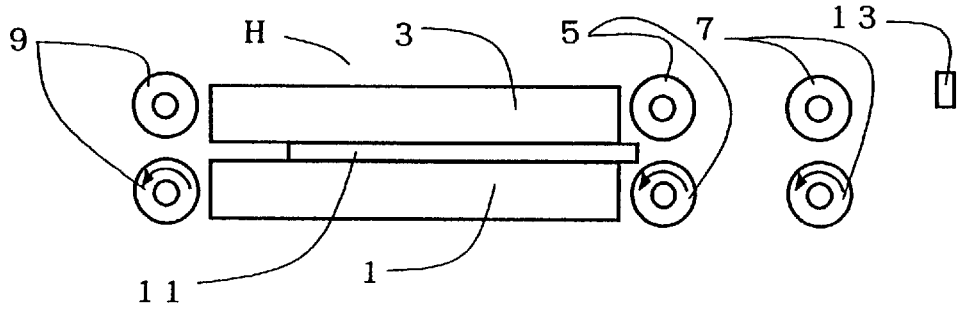
FIGS. 13 to 14 are similar schematic illustrative side views showing part of steps of operation in a modified embodiment according to the invention.
Figure 14:
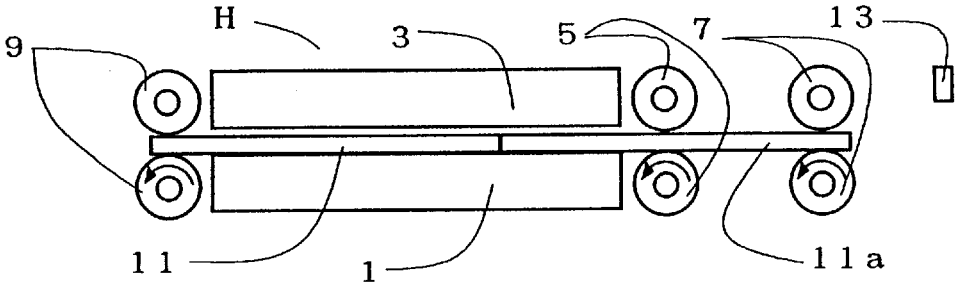

If a veneer sheet dried by being hot pressed with part of either end portion thereof lying outside the hot plates 1, 3 offers no problem for its application, the step to allow a succeeding veneer sheet to abut against the trailing end of and push its preceding veneer sheet for positioning of the latter veneer sheet at a predetermined position within the working apparatus, as shown for example in FIG. 6, may be omitted. In such an embodiment, after a veneer sheet 11 has been inserted into the space between the hot plates 1, 3 as shown in FIG. 2, it may be hot pressed as it is with part of its trailing end portion lying outside the hot plates 1, 3 as shown in FIG. 13. This may be followed by steps of elevating the upper hot plate 3 and then feeding a succeeding veneer sheet 11*a* into abutment with the trailing end of the dried veneer sheet 11 and pushing it forward until its leading end reaches the delivery rolls 9, as illustrated in FIG. 14. The dried veneer sheet 11 is removed by the delivery rolls 9 from the drier H and the subsequent veneer sheet 11*a* is moved to the position shown in FIG. 2 or FIG. 13 to which its preceding veneer sheet was conveyed previously by the feed rolls 5, 7. The veneer sheet 11*a* is hot pressed in the same manner as its preceding veneer sheet 11, and steps of operation shown in FIGS. 2, 13 and 14 are repeated for drying veneer sheets successively. As apparent from the foregoing description, method of this embodiment can dispense with the steps of reversing the feed rolls 5, 7.

Figure 15:
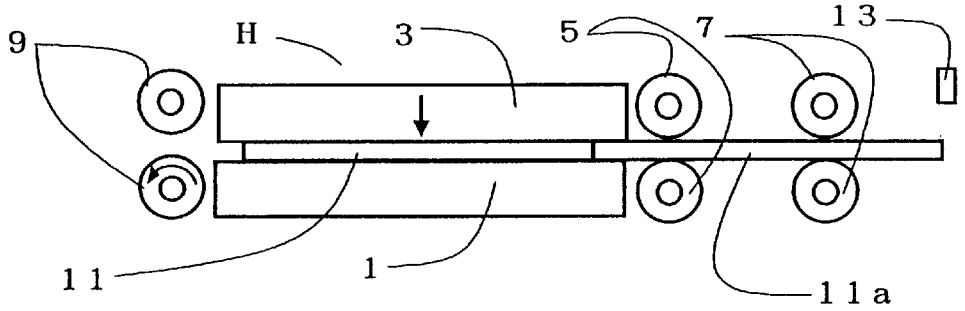
FIGS. 15 to 16 are similar schematic illustrative side views showing part of steps of operation in another modified embodiment according to the invention.
Figure 16:
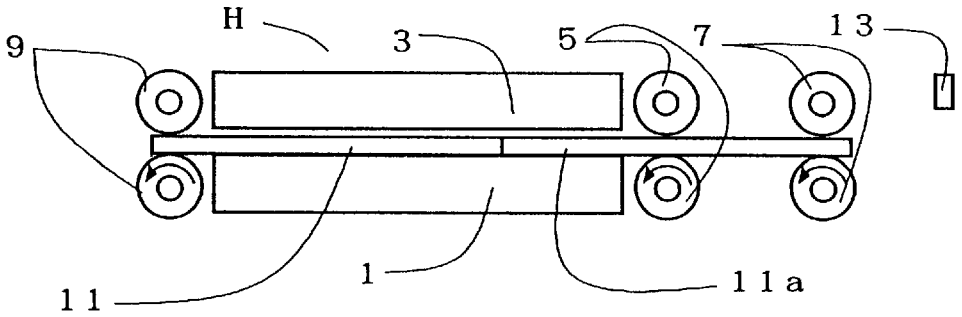

Operation to reverse the feed rolls 5, 7 may be also omitted in the modified embodiment illustrated in FIGS. 15 and 16. In this embodiment, firstly steps of operation shown in FIGS. 1 to 5 are performed. After the veneer sheet 11 has been pushed by its succeeding sheet 11*a* and located entirely within the pressing area of the hot plates 1, 3 and the feed rolls 5, 7 are stopped as shown in FIG. 5, the upper hot plate 3 is lowered to its operative pressing position as shown in FIG. 15, with the result that the entire veneer sheet 11 and part of the leading end portion of its succeeding veneer sheet 11*a* are hot pressed simultaneously for drying. After the drying has been completed, the hot plate 3 is moved to its elevated position and the feed rolls 5, 7 are activated again, so that the veneer sheet 11*a* is moved forward while pushing its preceding sheet 11 as shown in FIG. 16. The veneer sheet 11 is removed from the hot plates 1, 3 when its leading end reaches the delivery rolls 9. The succeeding veneer sheet 11*a* is moved further to the position as shown in FIG. 2, and thereafter steps of FIGS. 3 to 5, 15 and 16 are repeated.

Referring now to FIGS. 17 to 24, there is shown still another embodiment of the present invention. Reference numeral 15 in the drawings designates a stop 15 located between the upstream end of the lower stationary hot plate 1 and the feed rolls 5 adjacent thereto. The stop 15 extends perpendicularly to the longitudinal extension L1 of the hot plates 1, 3 and it is operable from a control signal from the control (not shown) to swing as indicated by double-head arrow between upright operative position (solid line) and inoperative position (dotted line).

Figure 17:
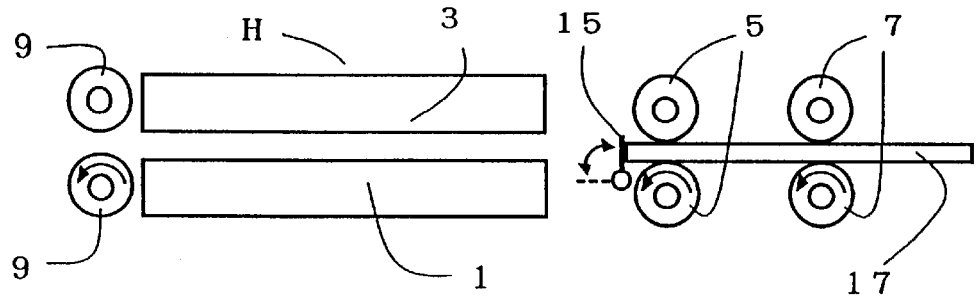
FIGS. 17 to 23 are also similar schematic illustrative side views showing steps of operation in still another embodiment according to the invention.
Figure 18:
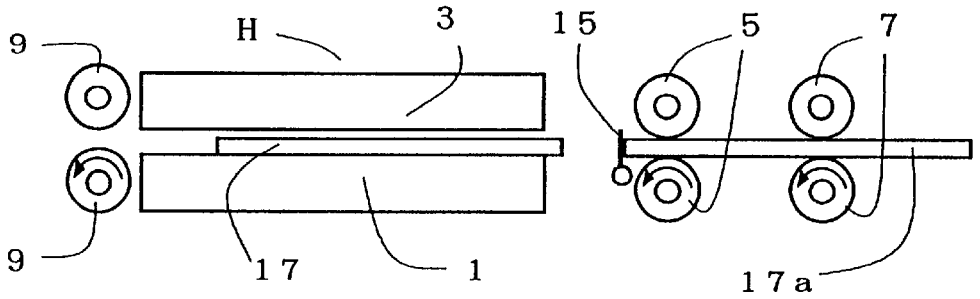

With the stop 15 placed in its upright position, a first veneer sheet 17 is moved by the feed rolls 5, 7 into contact with the stop 15 as shown in FIG. 17. In so doing, a veneer sheet being moved in a slightly oblique position can be oriented or aligned straight with respect to the direction in which the sheet is to be fed into the dryer H. Apparently, slippage occurs for a short period of time between the veneer sheet surfaces and the feed rolls 5, 7 during such aligning operation. After the veneer sheet 17 has been thus oriented, the stop 15 is turned to its dotted line position to allow the sheet 17 to move forward by the feed rolls 5, 7 to a position between the hot plates 1, 3 with part of its trailing end portion lying outside the longitudinal extension L1 of the hot plates 1, 3, as shown in FIG. 18. When the veneer sheet 17 has moved past the stop 15, the stop 15 is swung back to its upright position and a succeeding veneer sheet 17*a* is fed by the feed rolls 5, 7 into contact with the stop 15, as shown in FIG. 18, to be aligned in the same manner as its preceding veneer sheet 17.

Figure 19:
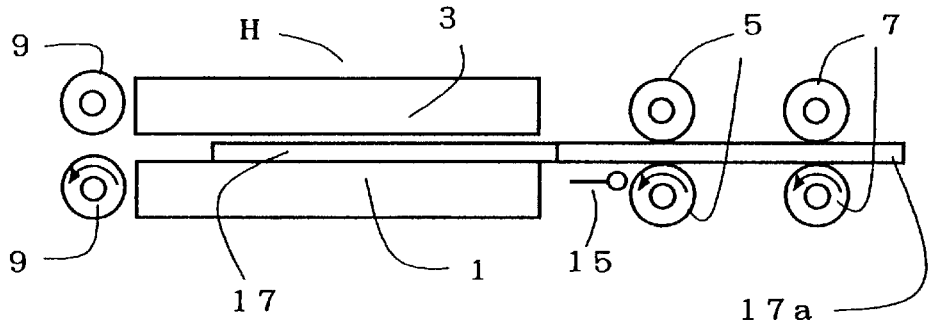
Figure 20:
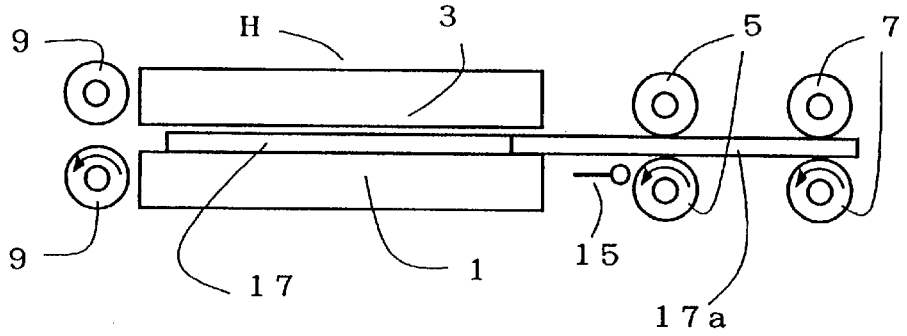

Then, the stop 15 is turned down to its dotted position to allow the veneer sheet 17*a* to moved forward into abutment contact with the trailing end of its preceding veneer sheet 17 as shown in FIG. 19 and pushes the sheet 17 to a predetermined position within the space between the hot plates 1, 3 as shown in FIG. 20. Since the distance from a given point of the dryer H to the stop 15 is known and the lower feed rolls are driven at a constant speed, movement of the veneer sheet 17 to the above predetermined position (FIG. 20) may be accomplished by counting time by a timer (not shown) from the moment when the stop 15 is turned inoperative and stopping the feed rolls 5, 7 when a predetermined length of time corresponding to the distance the veneer sheet 17 should be moved to reach the position of FIG. 20 has been counted by the timer.

Figure 21:
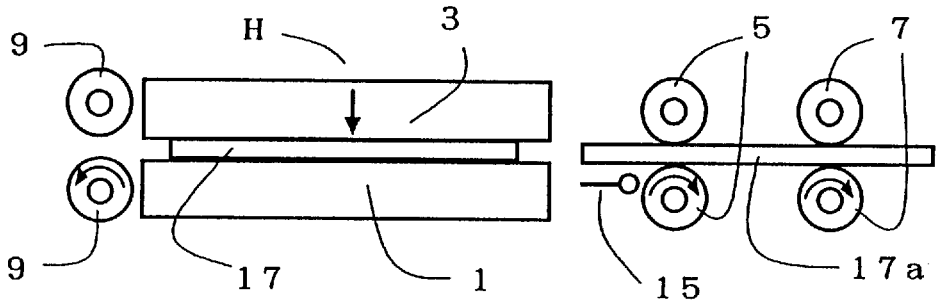
Figure 22:
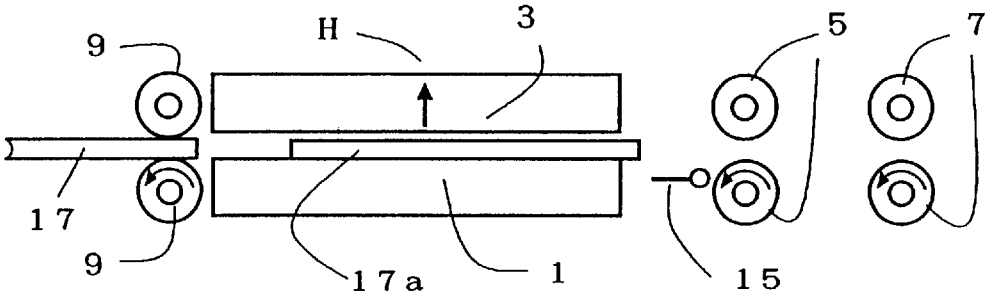
Figure 23:
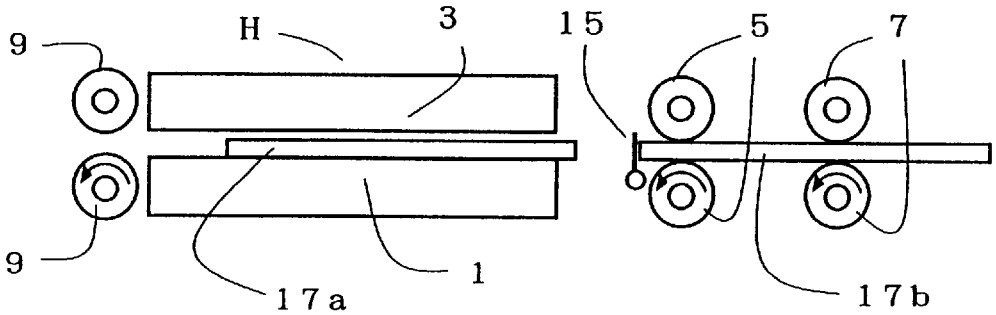
Figure 24:
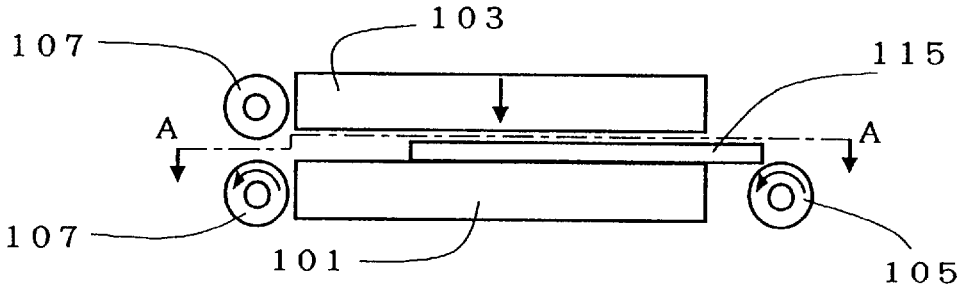
FIG.24 PRIOR ART
FIGS. 24 to 27 are schematic illustrative side views showing the operation of a hot press type veneer drying apparatus in a conventional method.

After the veneer sheet 17 has reached the position of FIG. 20, the feed rolls 5, 7 are reversed to move the succeeding sheet 17*a* to a position clear of the hot plates 1, 3 and, simultaneously, the upper hot plate 3 is lowered to press the veneer sheet 17, as shown in FIG. 21. After the pressing has been completed, the hot plate 3 is elevated and the feed rolls 5, 7 are driven forward to move the subsequent veneer sheet 17*a* into the space between the hot plates 1, 3, so that its preceding veneer sheet 17 is pushed thereby forward until its leading end is held between the delivery rolls 9, which then removes the sheet 17 out of the dryer H, and the second veneer sheet 17*a* is placed at the position to which its preceding sheet 17 was moved previously by the feed rolls 5, 7, as shown in FIG. 22. Then, the stop 15 is swung to its upright position to stop a further incoming veneer sheet 17*b*, which is the same condition as that of FIG. 18. Steps of operation of FIGS. 18 to 22 are repeated to successively feeding and pressing veneer sheets.

As will be understood by those skilled in the art, when a veneer sheet is brought into abutting contact with the trailing end of its preceding veneer sheet and moves the latter sheet by pushing, both veneer sheets receive a force acting in the direction in which they are moved, which force tends to cause the sheet to be bent. In a worst case, such bending may cause a break to the veneer sheet. The same is true when a veneer sheet is moved into contact with the stop 15 for alignment. As mentioned earlier, therefore, it is desirable that each veneer sheet should be transferred with its general fiber orientation directed along the direction in which it is moved, for veneer sheet to have a strength to resist the above bending force. For same purpose, veneer sheets to be transferred through a working apparatus according to the present invention should be thick enough for the sake of stability of transferring operation.

It is noted that the feed rolls 5, 7 may take any form of conveying means operable to feed sheet material, such as conveyer belts trained round pulleys. Though the above embodiments have been described with reference to a hot press type veneer dryer, the method according to the invention is applicable to other working apparatuses such as cold press, etc. and the sheet material to be transferred through the working apparatus may be materials other than veneer sheets, such as plywood panel, laminated wood board, medium density fiberboard (MDF), etc. Additionally, it is to be noted that the hot press type veneer dryer is not limited to the structure as illustrated in the drawings and the above description of various embodiments, but dryers of other structures may be contemplated for use in performing the method of the invention.

While the invention has been described and illustrated with reference to the specific embodiments, it is to be understood that the invention can be practiced in other various changes and modifications without departing from the spirit or scope thereof.

What is claimed is:

1. A method of transferring a sheet through a working apparatus having a working area with a dimension L1 as measured along a direction in which the sheet is transferred, said sheet having a dimension L2, as measured along said direction, which is smaller than said dimension L1, said working apparatus having feed means disposed adjacent to one end of the working area, capable of moving the sheet partially into the working area with part of the trailing end portion of the sheet lying outside the working area and operable to be reversed for moving the sheet away from the working area and delivery means disposed adjacent to the other end of the working area for removing the sheet therefrom, comprising:

moving by said feed means a first sheet partially into the working area;

moving by said feed means a second sheet into abutment of the leading end thereof with the trailing end of its preceding first sheet and further thereby to cause said second sheet to push said first sheet to a predetermined position within said working area;

moving by said feed means said second sheet back out of said working area;

working the entire of said first sheet by the working apparatus;

moving by said feed means said second sheet into abutment of the leading end thereof with the trailing end of its preceding worked first sheet and further to a position to which said first sheet was previously moved by said feed means, while causing said second sheet to push said first sheet toward said delivery means;

removing by said delivery means said first sheet out of said working area.

2. A method of transferring a sheet through a working apparatus having a working area with a dimension L1 as measured along a direction in which the sheet is transferred, said sheet having a dimension L2, as measured along said direction, which is smaller than said dimension L1, said working apparatus having feed means disposed adjacent to one end of the working area and capable of moving the sheet partially into the working area with part of the trailing end portion of the sheet lying outside the working area and delivery means disposed adjacent to the other end of the working area for removing the sheet therefrom, comprising:

moving by said feed means a first sheet partially into said working area;

working by the working apparatus part of said first sheet which lies within said working area;

moving by said feed means a second sheet into abutment of the leading end thereof with the trailing end of its preceding worked first sheet and further to a position to which said first sheet was previously moved by said feed means, while causing said second sheet to push said first sheet toward said delivery means;

removing by said delivery means said first sheet out of said working area.

3. A method of transferring a sheet through a working apparatus having a working area with a dimension L1 as measured along a direction in which the sheet is transferred, said sheet having a dimension L2, as measured along said direction, which is smaller than said dimension L1, said working apparatus having feed means disposed adjacent to one end of the working area and capable of moving the sheet partially into the working area with part of the trailing end portion of the sheet lying outside the working area and delivery means disposed adjacent to the other end of the working area for removing the sheet therefrom, comprising:

moving by said feed means a first sheet partially into said working area;

moving by said feed means a second sheet into abutment of the leading end thereof with the trailing end of its preceding first sheet and further thereby to cause said second sheet to push said first sheet to a predetermined position within said working area;

working simultaneously by the working apparatus the entire of said first sheet and part of the leading end portion of said second sheet which then lies within said working area;

moving by said feed means said second sheet to a position to which said first sheet was previously moved by said feed means, while causing said second sheet to push said first sheet toward said delivery means;

removing by said delivery means said first sheet out of said working area.

4. Method according to claim 1, 2 or 3, said working apparatus includes means disposed between said one end of the working area and said feed means for aligning each sheet straight with respect to the direction in which the sheet is moved by said feed means, further comprising aligning each sheet by said aligning means before it is moved by said feed means into said working area.

5. A method according to claim 4, wherein said aligning means includes a stop member extending across the direction in which the sheet is moved by said feed means so that the leading end of an incoming sheet is allowed to be brought into contact with said stop member.

6. A method according to claim 1, 2 or 3, wherein said working apparatus includes a hot press type veneer dryer having at least two hot plates disposed so as to form a space between said hot plates defining said working area having said dimension L1, said sheet includes a sheet of wood veneer having said dimension L2, said hot plates being operable to work the veneer sheet by hot pressing between any two adjacent hot plates.

7. A method of transferring a sheet of wood veneer through a hot press type veneer dryer having at least two hot plates disposed so as to form a space between said hot plates defining a working area of the dryer with a dimension L1 as measured along a direction in which the veneer sheet is transferred, said veneer sheet having a dimension L2, as measured along said direction, which is smaller than said dimension L1, said hot plates being operable to a hot pressing position for hot pressing a veneer sheet placed in said space and to a release position for releasing the veneer sheet from such hot pressing, said veneer dryer having feed means disposed adjacent to one end of the working area, capable of moving the veneer sheet forward partially into the working area with part of the trailing end portion of the sheet lying outside the working area and operable to be reversed for moving the veneer sheet away from the working area and delivery means disposed adjacent to the other end of the working area for removing the veneer sheet therefrom, comprising:

moving by said feed means a first veneer sheet forward partially into said working area with said hot plates placed in the release position thereof;

moving by said feed means a second veneer sheet forward into abutment of the leading end thereof with the trailing end of its preceding first veneer sheet and further thereby to cause said second veneer sheet to push said first veneer sheet forward to a predetermined position within said working area;

returning said second sheet until it comes out of said working area by reversing said feed means;

hot pressing the entire of said first veneer sheet by placing and holding said hot plates in the hot pressing position thereof for a predetermined length of time;

after an elapse of said predetermined length of time, moving the movable hot plate to its release position and then moving by said feed means said second veneer sheet into abutment of the leading end thereof with the trailing end of its preceding pressed first veneer sheet and further to a position to which said first veneer sheet was previously moved by said feed means, while causing said second veneer sheet to push said first veneer sheet toward said delivery means;

removing by said delivery means said first veneer sheet out of said working area.

8. A method according to claim 7, wherein said hot plates include a pair of hot plates disposed one above the other, at least one of said paired hot plates being movable toward and away from the other for hot pressing and releasing of the veneer sheet, respectively.

* * * * *

UNITED STATES PATENT AND TRADEMARK OFFICE

CERTIFICATE OF CORRECTION

PATENT NO. : 6,363,845 B1
DATED : April 2, 2002
INVENTOR(S) : Noriyuki Honda

It is certified that error appears in the above-identified patent and that said Letters Patent is hereby corrected as shown below:

Title page,
Item [56], References Cited, U.S. PATENT DOCUMENTS, please delete "4,253,891 A * 3/1981 Posselt" and insert therefor -- 4,253,891 A * 3/1981 Brussel --

Signed and Sealed this

Fourth Day of June, 2002

*Attest:*

*Attesting Officer*

JAMES E. ROGAN
*Director of the United States Patent and Trademark Office*